United States Patent [19]

Takenoya

[11] 4,368,682

[45] Jan. 18, 1983

[54] ELECTRONIC SEWING MACHINE WITH PATTERN ELONGATION SYSTEM

[75] Inventor: Hideaki Takenoya, Hachioji, Japan

[73] Assignee: Janome Sewing Machine Co. Ltd., Tokyo, Japan

[21] Appl. No.: 280,510

[22] Filed: Jul. 6, 1981

[30] Foreign Application Priority Data

Jul. 8, 1980 [JP] Japan ..... 55/92271

[51] Int. Cl.[3] ..... D05B 3/02

[52] U.S. Cl. ..... 112/158 E

[58] Field of Search ..... 112/158 E, 121.11, 121.12, 112/314, 315, 303

[56] References Cited

U.S. PATENT DOCUMENTS 4,210,088 7/1980 Takenoya et al. ..... 112/158 E
4,242,974 1/1981 Beckerman ..... 112/158 E
4,259,913 7/1981 Takenoya et al. ..... 112/158 E
4,261,271 4/1981 Makabe et al. ..... 112/158 E
4,280,424 7/1981 Carbonato et al. ..... 112/158 E

*Primary Examiner*—Peter P. Nerbun
*Attorney, Agent, or Firm*—Michael J. Striker

[57] ABSTRACT

A pattern elongation system in an electronic sewing machine includes a number of switches on the housing of the machine and a rotatable knob for actuating a pattern selecting circuit of the pattern elongation system. The pattern elongation system further includes a memory for storing stitch control data and a discriminating signal, a pulse generator operated in synchronism with rotation of the upper drive shaft of the machine and producing a timing pulse, an oscillator cooperating with the pulse generator to address the memory per stitch of the pattern, and a comparator which compares the elongation signal and the discriminating signals to cause the oscillator to determine the addresses for the stitches of pattern.

2 Claims, 4 Drawing Figures

FF2
MM2
SG
OR3
OR2
NOR2
NOR1
ExOR1
ExOR2
ExOR3
TD2
AM
AND7
AND6
AND5
AND4
ACT
L2
TD1
AND2
OR1
AND3
OOO1
FF1
OR2
ROM
TD3
MM1
NA4
L1
NA3
NA2
NA1
R1
AND1
AD
R2
SW8
VR
SW1
SW2
SW3
SW4
SW5
SW6
SW7
Vcc
2
3

FIG_4

| Address | $D_7$ | $D_6$ | $D_5$ | $D_4$ | $D_3$ | $D_2$ | $D_1$ | Dp |
|---|---|---|---|---|---|---|---|---|
| 0 | 0 | 0 | 0 | 1 | 0 | 0 | 0 | 15 |
| 1 | 0 | 0 | 0 | 1 | 0 | 0 | 0 | 18 |
| n - 1 | 0 | 0 | 0 | 1 | 0 | 1 | 1 | 30 |
| n | 1 | 1 | 1 | 1 | 1 | 0 | 0 | 15 |
| n + 1 | 1 | 1 | 1 | 0 | 1 | 0 | 0 | 16 |
| n + 2 | 1 | 1 | 0 | 0 | 1 | 0 | 0 | 14 |
| n + 3 | 1 | 1 | 0 | 1 | 1 | 0 | 0 | 17 |
| n + 4 | 1 | 0 | 1 | 0 | 1 | 0 | 0 | 13 |
| n + 5 | 1 | 0 | 1 | 0 | 1 | 0 | 0 | 18 |
| n + 6 | 1 | 1 | 0 | 1 | 1 | 0 | 0 | 12 |
| n + 7 | 1 | 1 | 0 | 0 | 1 | 0 | 0 | 19 |
| n + 8 | 1 | 1 | 1 | 0 | 1 | 0 | 0 | 11 |
| n + 9 | 1 | 1 | 1 | 1 | 1 | 0 | 0 | 20 |
| n + 10 | 1 | 0 | 0 | 0 | 1 | 0 | 0 | 10 |
| n + 11 | 1 | 0 | 0 | 0 | 1 | 0 | 0 | 21 |
| n + 12 | 1 | 1 | 1 | 1 | 1 | 0 | 0 | 19 |
| n + 13 | 0 | 1 | 0 | 0 | 1 | 0 | 0 | 21 |
| n + 14 | 1 | 0 | 1 | 0 | 1 | 0 | 0 | 22 |
| n + 15 | 1 | 1 | 1 | 0 | 1 | 0 | 0 | 8 |
| n + 16 | 1 | 1 | 0 | 1 | 1 | 0 | 0 | 23 |
| n + 17 | 1 | 1 | 0 | 0 | 1 | 0 | 0 | 7 |
| n + 18 | 1 | 1 | 1 | 0 | 1 | 0 | 0 | 24 |
| n + 19 | 1 | 0 | 1 | 1 | 1 | 0 | 0 | 6 |
| n + 20 | 1 | 0 | 0 | 0 | 1 | 0 | 0 | 25 |
| n + 21 | 1 | 1 | 0 | 0 | 1 | 0 | 0 | 5 |
| n + 22 | 1 | 1 | 1 | 0 | 1 | 0 | 0 | 26 |
| n + 23 | 1 | 1 | 1 | 0 | 1 | 0 | 0 | 4 |
| n + 24 | 1 | 1 | 0 | 1 | 1 | 0 | 0 | 27 |
| n + 25 | 1 | 1 | 0 | 1 | 1 | 0 | 0 | 3 |
| n + 26 | 1 | 0 | 1 | 0 | 1 | 0 | 0 | 28 |
| n + 27 | 1 | 0 | 1 | 0 | 1 | 0 | 0 | 2 |
| n + 28 | 1 | 1 | 0 | 0 | 1 | 0 | 0 | 29 |
| n + 29 | 1 | 1 | 0 | 0 | 1 | 0 | 0 | 1 |
| n + 30 | 1 | 1 | 1 | 1 | 1 | 0 | 0 | 30 |
| n + 31 | 1 | 1 | 1 | 1 | 1 | 0 | 0 | 0 |
| | 1 | 0 | 1 | 1 | 1 | 0 | 1 | 15 |
| m - 1 | 1 | 1 | 1 | 1 | 1 | 1 | 0 | 0 |
| m | 1 | 1 | 1 | 1 | 1 | 1 | 0 | 30 |

ELECTRONIC SEWING MACHINE WITH PATTERN ELONGATION SYSTEM

BACKGROUND OF THE INVENTION

The invention relates to an electronic sewing machine and more particularly relates to a pattern elongation system of the sewing machine to produce a pattern of stitches enlarged or reduced in the fabric feeding direction with a constant feeding pitch such as the satin stitches. The sewing machine has an electronic memory storing stitch control data which are optionally read out to control the needle positions, so as to adjust the configuration of a pattern of stitches in a manner as mentioned.

According to the pattern elongation device of the sewing machine, the transmission mechanism from a pattern cam to the stitch forming instrumentalities is mechanically adjusted, and therefore the device is in general mechanically complex to produce various elongated patterns symmetrical or asymmetrical, and has been actually difficult to be reduced into practice. In fact, no pattern elongation device or system has been proposed in an electronic sewing machine having a memory storing the stitch control data.

SUMMARY OF THE INVENTION

According to the invention, the stitch control data are optionally read out from the electronic memory in accordance with the designations for enlarging or reducing a pattern in the fabric feeding direction. The memory stores a discriminating signal each in pair with each of the stitch control data for discriminating, in response to the enlarging or reducing designations of a pattern, whether or not each stitch control date may be employed to a single pattern or may be employed commonly to different patterns. A pattern elongation selecting part is operated to produce an elongation signal. A pulse generator is operated in synchronism with rotation of the upper drive shaft of the sewing machine to produce a timing pulse per rotation of the upper drive shaft. An oscillator is operated in relation to the timing pulse to address the memory per stitch of the pattern, thereby to scan the locations of the stitch control data. A comparator compares the elongation signal and the discriminating signals to cause the oscillator to determine the addresses for the stitches of pattern. The data of the memory may be employed commonly to different patterns so as to effectively use the function of the memory. Thus the elongation as well as the reduction of a pattern may be optionally selected by easy operation of the sewing machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 4 is a table showing the addresses and the corresponding data of memory.

DETAILED DESCRIPTION OF THE INVENTION

Figure 1:
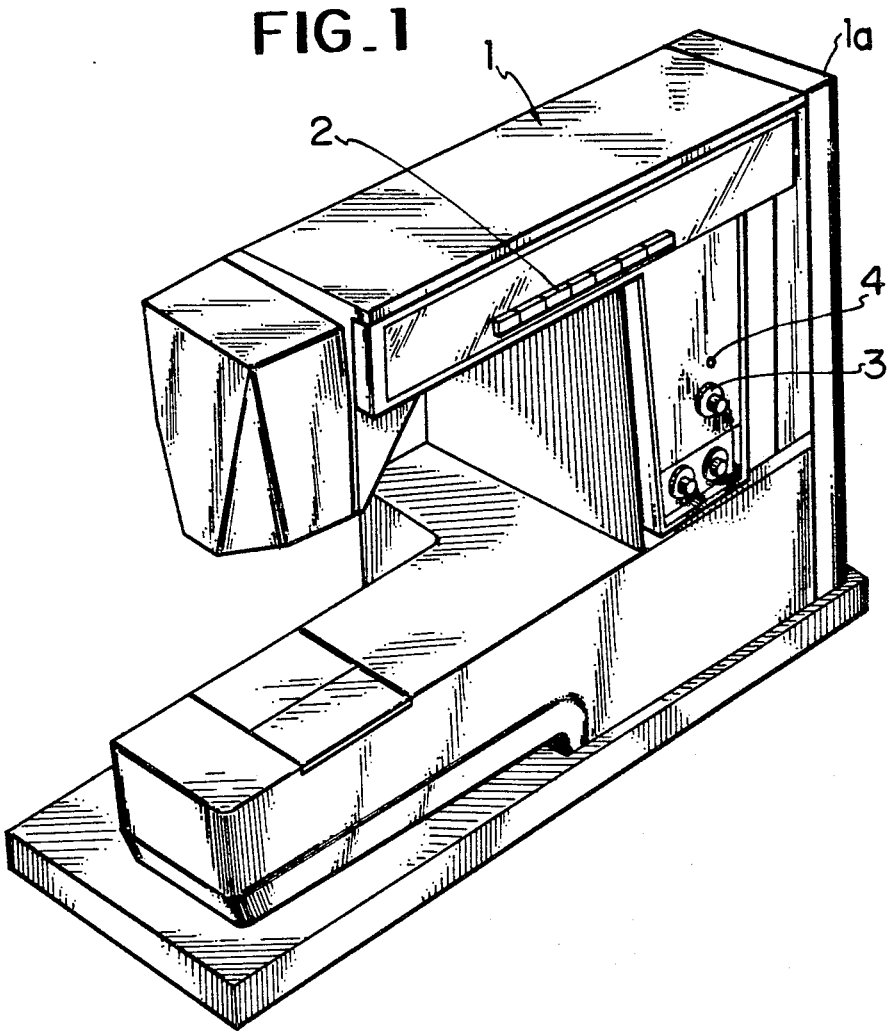
FIG. 1 is a perspective view of a sewing machine incorporated with the invention.

In reference to FIG. 1 a sewing machine 1 has a housing 1*a* providing a front face thereof. A predetermined number of pattern selecting switches 2 are arranged on the front face of the sewing machine. An operating knob 3 is provided on the front face of the sewing machine at a position spaced from the pattern selecting switches 2 as shown. The operating knob 3 is pushed to make effective or ineffective an elongation mechanism of the sewing machine for elongating a selected pattern. The degree of the elongation is determined by rotation of the operating knob 3. An indicating lamp 4 is provided on the front face of the sewing machine in the neighbourhood of the operating knob 3. The lamp 4 is lighted to indicate that the elongation mechanism is effective.

Figure 2:
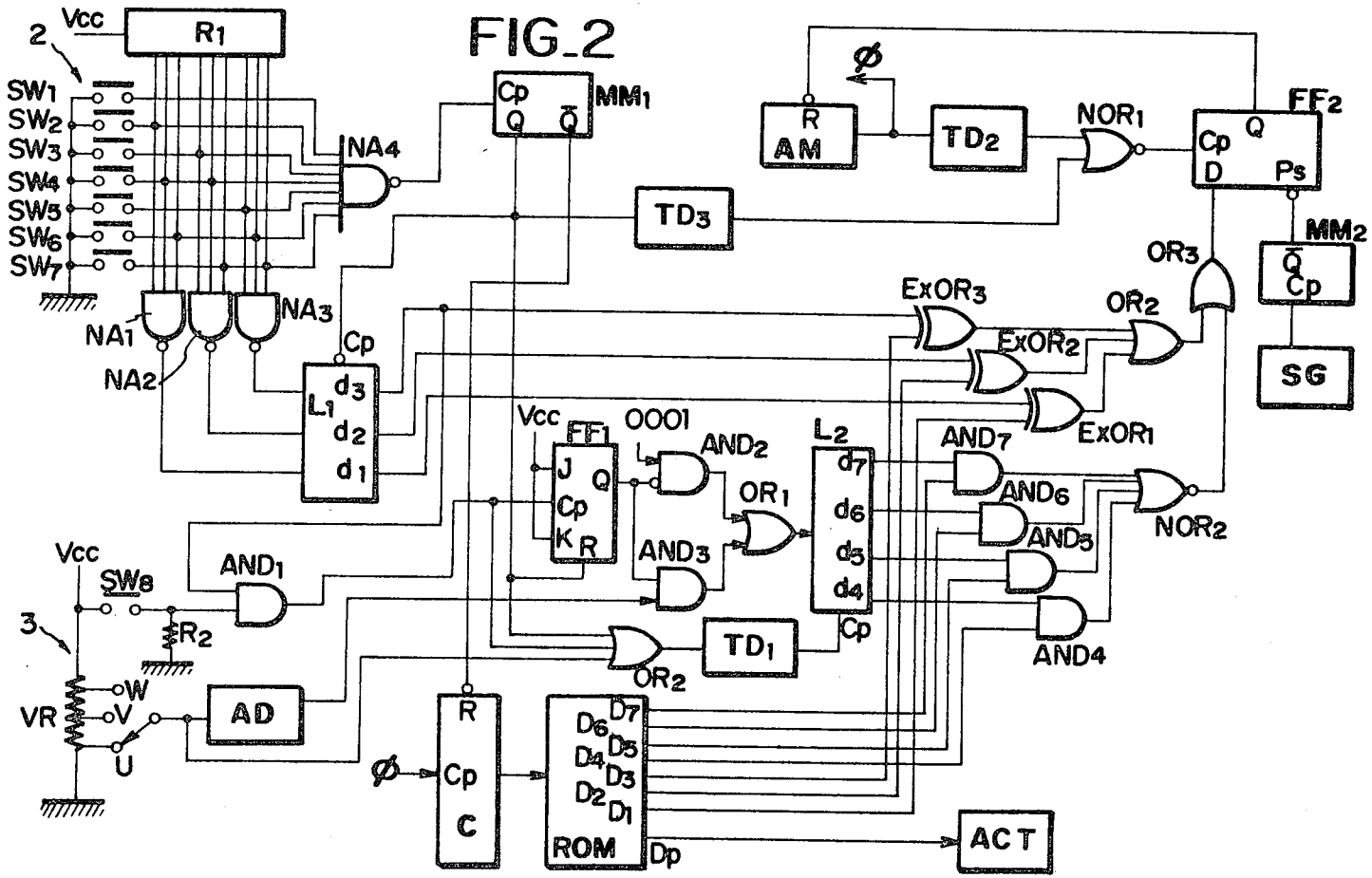
FIG. 2 is a control circuit of the invention.

In reference to FIG. 2 showing a control circuit of the invention, the pattern selecting switches 2 are specifically indicated by SW1–SW7. Those are normally opened switches each having one end grounded and the other end connected to a positive control power source Vcc through a pull-up resistor R1. If the pattern selecting switches SW1–SW7 are selectively operated to select different patterns, the other end of the operated switch becomes low level and NAND circuits NA2, NA3 produce a specific code signal to a latch circuit L1. NAND circuit NA4 produces a high level signal to a monostable multivibrator circuit MM1 when one of the switches SW1–SW7 is operated. Then the positive output Q of the monostable multivibrator circuit MM1 gives a trigger signal to the trigger terminal of the latch circuit L1 for latching the pattern code.

SW8 is a normally opened switch which is closed each time when the operating knob 3 is pushed. The switch SW8 has one end grounded through a resistor R2 to always remain low level and the other end connected to the power source Vcc to be high level when the switch SW8 is closed. The high level signal is applied to AND circuit AND1, which give the high level signal to the trigger terminal Cp of a JK-type flip-flop circuit FF1 only when a specifice bit (d3) of the outputs (d1, d2, d3) of the latch circuit L1 is high level. The flip-flop circuit FF1 has terminals J, K connected to the power source Vcc and a reset terminal R connected to the positive output Q of the monostable multivibrator circuit MM1. The flip-flop FF1 is reset when a pattern is selected by operation of one of the switches SW1–SW7 and the output Q remains low level as long as the switch is not operated subsequently. The output Q is inverted each time the switch SW8 is operated in the condition that one of the pattern selecting switches SW5, SW6, SW7 for selecting elongatable patterns SW5, SW6, SW7 is operated and therefore the output (d3) of the latch circuit L1 becomes high level.

AND circuit AND2 has one input terminal receiving a code 0 0 0 1 for nullifying the elongation mechanism of the sewing machine and automatically restoring the sewing machine to a condition for producing a standard form of the selected pattern. The AND circuit AND2, has the other input terminal receiving the output Q of the flip-flop circuit FF1 in the inverted condition, and gives the code 0 0 0 1 to a latch circuit L2 through OR circuit OR1 when the output Q is low level.

The operating knob 3 is rotated to operate a variable resistor VR so as to take out adjusted potentials U, V, W from the power source Vcc. An analog-digital converter AD converts the adjusted potential into a digital value and gives the same to one input terminal of AND circuit AND3. The AND circuit AND3 has the other input terminal connected to the output Q of the flip-flop circuit FF1 through the OR circuit OR1, and gives the code of the analog-digital converter AD to the latch circuit L2 when the output Q of the flip-flop circuit FF1 is high level, i.e. when the switch SW8 is operated to make effective the elongation mechanism.

The indicating lamp 4 in FIG. 1 is lighted when the output Q of the flip-flop circuit FF1 is high level, though such a circuit is not shown. OR circuit OR2 receives a pulse to operate a delay circuit TD1 each time a changeover is made between the positive output Q of the monostable multivibrator MM1, the output of the AND circuit AND1 and the output terminals U, V, W of the variable resistor VR, thereby to give a trigger signal to the trigger terminal Cp of the latch circuit L2. Thus the input signal is latched to the output terminals (d4)–(d7) of the latch circuit L2 through the OR circuit OR1 each time when one of the switches 2, the switch SW8 or the variable resistor VR is operated.

A counter of master-slave type C has a reset terminal R connected to the complement output $\overline{Q}$ of the monostable multivibrator circuit MM1 and the output side binary code connected to an electronic memory ROM. The counter C produces a progressive code signal each time it receives an input pulse $\phi$ at the input terminal Cp and progressively advances the addresses of the memory ROM from (o) to (m) repeatedly as shown by decimal numbers in FIG. 4. The outputs (D1)(D2)(D3) of the outputs of the memory ROM are respectively connected to the inputs of exclusive OR circuits ExOR1, ExOR2, ExOR3 each in pair with the outputs (d1)(d2)(d3) of the latch circuit L1. The exclusive OR circuits ExOR1, ExOR2, ExOR3 have the outputs respectively connected to the data terminal D of a D-type flip-flop circuit FF2 through OR circuits OR2, OR3. The flip-flop circuit FF2 has the output Q which is reset to O when the power source Vcc is applied though the circuit is not shown. The output Q is connected to the reset terminal of an astable multivibrator circuit AM.

The astable multivibrator circuit AM has a pulse output terminal $\phi$ which is connected to a delay circuit TD2 and to the input terminal Cp of the counter C. NOR circuit NOR1 has an input connected to the output of the delay circuit TD2 and another input connected to the output of a delay circuit TD3 which as an input connected to the positive output Q of the monostable multivibrator circuit MM1. The NOR circuit NOR1 has an output connected to the trigger terminal Cp of the flip-flop circuit FF2.

The outputs D4–D7 of the memory ROM are connected to the inputs of AND circuits AND4–AND7 each in pair with the outputs (d4)–(d7) of the latch circuit L2, and the outputs of these AND circuits are connected to the data terminal D of the flip-flop circuit FF2 through NOR circuit NOR2 and the OR circuit OR3.

A pulse generator SG produces a timing pulse per rotation of an upper drive shaft of the sewing machine (not shown) when a needle bar (not shown)is at a predetermined position during the vertical reciprocation thereof. The timing pulse is applied to the trigger terminal Cp of a monostable multivibrator circuit MM2, so that the flip-flop circuit FF2 having a preset terminal Ps connected to the complement output $\overline{Q}$ of the monosable multivibrator MM2 may be preset with the rising signal applied thereat.

The data to the respective addresses in the memory are partly shown in FIG. 4. The code (D3, D2, D1) in accordance with the output terminals D3, D2, D1 of the memory ROM constitutes a pattern discriminating signal for designating an address to be employed in common to a signal (d3, d2, d1) of the latch circuit L1 and the corresponding signal (D3, D2, D1) in FIG. 4. Stitch control signals Dp in FIG. 4 are employed in accordance to the designated addresses to control the stitch forming instrumentalities of the sewing machine. In this embodiment, the signals Dp are shown with the decimal numbers for controlling the needle coordinates of the sewing machine.

Figure 3:
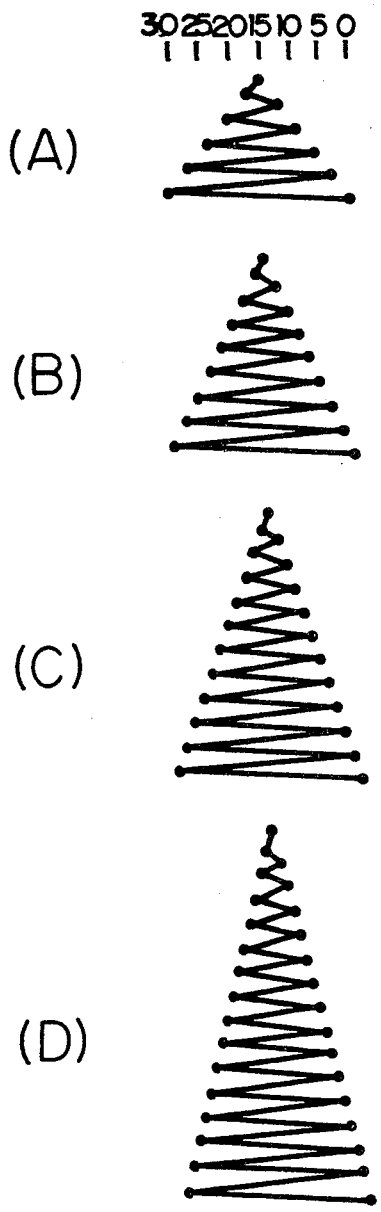
FIG. 3 is representation of patterns to be produced by the invention.

The code (D7, D6, D5, D4) at the output terminals D7, D6, D5, D4 of the memory ROM constitutes a discriminating signal for enlarging or reducing a stitch pattern. With the operated position of the switch SW8 and of the variable resistor VR due to the operation of the knob 3, the pattern elongation signal at the outputs (d7, d6, d5, d4) of the latch circuit L2 is compared to the signal (D7, D6, D5, D4) of the memory (ROM). If these two signals are same, this is indicated by the logic 1 and the corresponding address is designated and the corresponding stitch control signal Dp is employed. If the idenifying logic 1 represents the bits d4 and D4 of the signals, this corresponds to the selection of a pattern designating signal (input 0 0 0 1 of AND circuit AND2) for a standard pattern such as shown in FIG. 3 (A) is selected and to the reading-out of the corresponding stitch control signals. If the identifying logic 1 represents the bits d5 and D5 of the signals, this corresponds to the selection of the potential at the terminal U of the variable resistor VR and to the reading-out of the corresponding stitch control signals. As a result, a pattern is produced as shown in FIG. 3 (B), which is elongated twice of the standard pattern as shown in FIG. 3 (A). Similarly if the identifying logic 1 represents the bits d6 and D6 or d7 and D7 of the signals, this corresponds to the selection of the potential at the terminal V or W of the variable resistor VR and to the reading-out of the corresponding stitch control signals. As a result, a pattern is produced as shown in FIG. 3 (C) or in FIG. 3 (D), which is elongated three times or four times of the standard pattern as shown in FIG. 3 (A).

The memory ROM has an output terminal Dp for giving stitch control signals in the data Dp as shown in FIG. 4 to the stitch forming instrumentalities ACT of the sewing machine. The patterns shown in FIG. 3 are stitched with the fabric transported vertically in the forward direction while the needle is moved laterally. The fabric is transported with a constant feeding pitch and the needle is laterally moved from 15 at the center to maximum on both sides of the center. As shown in FIGS. 3 and 4, the center position of the needle is indicated by 15, the maximum movement of the needle in the rightward direction is indicated by O and the maximum movement of the needle in the leftward direction is indicated by 30.

According to the embodiment, the memory ROM produces the stitch control signals at the output terminal Dp thereof. It is however possible to produce calculating signals at the same output terminal for calculating out the stitch control signals.

Operation is as follows: Explanation will be made as to the formation of the pattern shown in FIG. 3 (B) which is applied with a constant feeding pitch. If the pattern selecting switch SW5 is pushed, the data (d3, d2, d1) of the latch circuit L1 becomes 1 0 0 meaning the selection of the standard pattern shown in FIG. 3 (A). In this case, the output Q of the flip-flop FF1 is low level, and therefore the data (d7, d6, d5, d4) of the latch circuit L2 becomes 0 0 0 1.

Then if the variable resistor VR is manipulated to connect the terminal U thereof to the analog-digital converter AD, and then if the switch SW8 is pushed, the output Q of the flip-flop circuit FF2 becomes high level and the data (d7, d6, d5, d4) of the latch circuit L2 becomes 0 0 1 0 in accordance to the potential at the terminal U of the variable resistor VR. Namely the logic 1 of the data (d5) designates the pattern shown in FIG. 3 (B).

With application of the control power source Vcc, the flip-flop circuit FF2 is firstly reset and the output Q has a logic 0 and the astable multivibrator circuit AM is reset. The counter C is reset by the abovementioned pushing operation of the switch SW5. The memory ROM is addressed at the address O and the data (D7–D1) becomes 0 0 0 1 0 0 0. Then the data (d3, d2, d1) and the data (D3, D2, D1) are compared. As the data are not in accord, the data input terminal of the flip-flop circuit FF2 becomes high level, and the output Q becomes high level with the continuous pulse signal of the delay circuit TD3 applied to the terminal Cp, and then the astable multivibrator circuit AM oscillates. When the address (n) is reached, the data (D7–D7) becomes 1 1 1 1 1 0 0, and the data is compared with 0 0 1 0 1 0 0 of the data (d7–d1). As the data D5 and d5 are logic 1, the NOR circuit NOR2 becomes 0. As the data D3, D2, D1 and d3, d2, d1 are 1 0 0, the OR circuit OR2 becomes 0, and therefore the terminal D of the flip-flop circuit FF2 becomes 0 and the output Q becomes low level, and then the oscillation of the astable multivibrator circuit AM is stopped.

Thus the memory ROM, when addressed at the address (n), produces the output data 15 at the output terminal Dp to operate the stitch forming instrumentalities ACT, thereby to form the initial stitch. Although the outputs at the addresses from (O) to (n−1) are applied to the stitch forming instrumentalities ACT, such outputs will not actually operate the stitch forming instrumentalities because the addressing operation by the counter C is made at an extremely high speed.

When the upper drive shaft of the sewing machine makes one complete rotation, the timing signal of the pulse generator SG sets the flip-flop circuit FF2 and the astable multivibrator circuit AM oscillates. As the counter C advances a number 1, as shown in FIG. 4 the data D5 at the address (n+1) is logic 1 and therefore the astable multivibrator AM stops the oscillation. Then the data 16 at the output Dp of the memory ROM control the second stitch. With further rotation of the upper drive shaft of the sewing machine, the data 5 at the addresses (n+2) and (n+3) are logic 0 and therefore these addresses are passed over. When the address (n+4) is reached, the data D5 is 1 and the data 13 at the output Dp controls the third stitch. As shown in FIG. 4, the following stitches are controlled by the data of the output Dp 18, 11, 20, 9, 22, 8, 24, 6, 26, 4, 28, 2, 30, and 0.

With further advance of the addresses, the data D3, D2, D1 and the data d3, d2, d1 are not in accord and the addresses (m and O) are passed over and the address (n) is reached. Thus the initial stitch of pattern is repeatedly produced.

In FIG. 4, the data D7–D4 including a plurality of logics 1 means that the data may be employed so many times to so many patterns to be elongated. At the addresses (n+11) and (n+13) the data Dp is 21. This is because the pattern such as shown in FIG. 3 (D) designating the bit D7 with logic 1 requires the data Dp to be adjacent to each other as 10 and 21 at the addresses (n+10) and (n+11) while the pattern such as shown in FIG. 3 (C) designating the bit D6 with logic 1 requires the data Dp to be set apart as 19 and 21 at the addresses (n+12) and (n+13). Since it is impossible to backwardly trace the addresses, the data are so located for convenience sake.

If the operating knob 3 is rotated to switch over from the terminal U to the terminal V of the variable resistor VR, the data (d7–d4) of the latch circuit L2 becomes 0 1 0 0 and the pattern shown in FIG. 3 (C) is produced. If the switch SW8 is pushed by pushing operation of the knob 3, the flip-flop circuit FF1 is inverted and the data (d7–d4) becomes 0 0 0 1 and the standard pattern shown in FIG. 3 (A) is produced.

It will be understood that each of the elements described above, or two or more together, may also find a useful application in other types of pattern elongation systems differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electronic sewing machine with a pattern elongation system of the type having a housing, stitch forming instrumentalities, a needle vertically and laterally reciprocated by rotation of an upper drive shaft and a fabric feeding device for transporting a fabric to be sewn with respect to the needle, a combination comprising pattern elongation selecting means operated to produce a pattern elongation signal designating the stitches of a selected pattern to be enlarged or reduced in a fabric feeding direction; a memory connected to the stitch forming instrumentalities and operative for storing stitch control data optionally addressed to read out to control at least the positions of the needle, said memory storing a discriminating signal in pair with each of the stitch control data in response to the enlarging or reducing designations of a pattern so that the stitch control data may be optionally read out; pulse generator means operated in synchronism with rotation of the upper drive shaft to produce a timing pulse per rotation of the upper shaft; addressing means including an oscillator operated in relation with the timing pulse of the pulse generator means to address the memory per stitch of the pattern and to thus progressively scan the locations of the stitch control data per stitch of the selected pattern; and comparator means for comparing the discriminating signal and the pattern elongation signal to cause the addressing means to determine the addresses of the stitch control data optionally addressed.

2. The combination of claim 1, wherein said pattern elongation selecting means include a plurality of switches on said housing, a knob on said housing adapted to be pushed and rotated, and a pattern selecting circuit actuated by said switches and said knob.

* * * * *